US009968968B2

(12) United States Patent
Vijapur et al.

(10) Patent No.: US 9,968,968 B2
(45) Date of Patent: May 15, 2018

(54) MACHINE FOR GRADING SMALL SIZED IRREGULAR OBJECTS AND A PROCESS THEREOF

(71) Applicant: NANOPIX INTEGRATED SOFTWARE SOLUTIONS PRIVATE LIMITED, Hubli (IN)

(72) Inventors: Anup Vijapur, Hubli (IN); Sasisekar Krish, Hubli (IN)

(73) Assignee: NANOPIX INTERGRATED SOFTWARE SOLUTIONS PRIVATE LIMITED, Hubli, State of Karnataka (IN)

( * ) Notice: Subject to any disclaimer, the term of this patent is extended or adjusted under 35 U.S.C. 154(b) by 196 days.

(21) Appl. No.: 15/035,647

(22) PCT Filed: Jun. 20, 2014

(86) PCT No.: PCT/IN2014/000413
§ 371 (c)(1),
(2) Date: May 10, 2016

(87) PCT Pub. No.: WO2015/128872
PCT Pub. Date: Sep. 3, 2015

(65) Prior Publication Data

US 2016/0279672 A1 Sep. 29, 2016

(30) Foreign Application Priority Data

Feb. 27, 2014 (IN) ..... 994/CHE/2014

(51) Int. Cl.
*B07C 5/00* (2006.01)
*B07C 1/04* (2006.01)
(Continued)

(52) U.S. Cl.
CPC ..... *B07C 1/04* (2013.01); *B07B 13/003* (2013.01); *B07B 13/08* (2013.01); *B07B 13/16* (2013.01); *B07C 5/3425* (2013.01)

(58) Field of Classification Search
CPC .... B07C 1/00; B07C 1/02; B07C 1/04; B07C 5/342; B07C 5/3425; B07B 13/00; B07B 13/003; B07B 13/08; B07B 13/16
(Continued)

(56) References Cited

U.S. PATENT DOCUMENTS 4,701,094 A * 10/1987 Courjaret ..... B07C 1/04 209/586
7,111,740 B2 * 9/2006 Ogawa ..... B07C 5/10 198/445

(Continued)

*Primary Examiner* — Joseph C Rodriguez
*Assistant Examiner* — Kalyanavenkateshware Kumar
(74) *Attorney, Agent, or Firm* — Holtz, Holtz & Volek PC

(57) ABSTRACT

A grading machine for grading small uneven objects includes: at least one feeding assembly including at least one main hopper for feeding; at least one vibrator for agitating objects to move them to at least one slider coupled with a feeding regulator; at least one tilted assembly including at least two sets of reverse roller pairs; at least one pick and place assembly including a vacuum rotating drum wherein an inner solid roller rotates; a tray assembly including a plurality of parallel trays, each including a cup assembly; at least one conveyor; at least two imaging systems which can see multiple sides of the objects for analysis of surface properties; at least one embedded intelligence system; at least one energizer box assembly including a plurality of energizer boxes; an ejection system for grading objects into categories based on their surface properties; and at least one main frame.

11 Claims, 6 Drawing Sheets

(51) Int. Cl.

| | |
|---|---|
| ***B07B 13/00*** | (2006.01) |
| ***B07B 13/08*** | (2006.01) |
| ***B07B 13/16*** | (2006.01) |
| ***B07C 5/342*** | (2006.01) |

(58) Field of Classification Search
USPC ..... 209/552, 557, 587, 588
See application file for complete search history.

(56) References Cited

U.S. PATENT DOCUMENTS 8,728,689 B2 * 5/2014 Ayaki ..... G03G 9/0821 430/111.4
9,040,859 B2 * 5/2015 Yamada ..... B07C 5/342 209/577

* cited by examiner

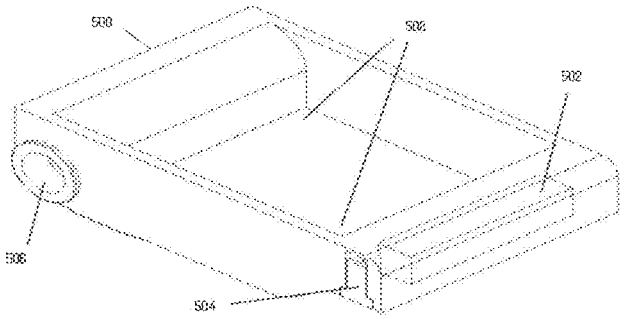
FIG. 5
FIG. 6
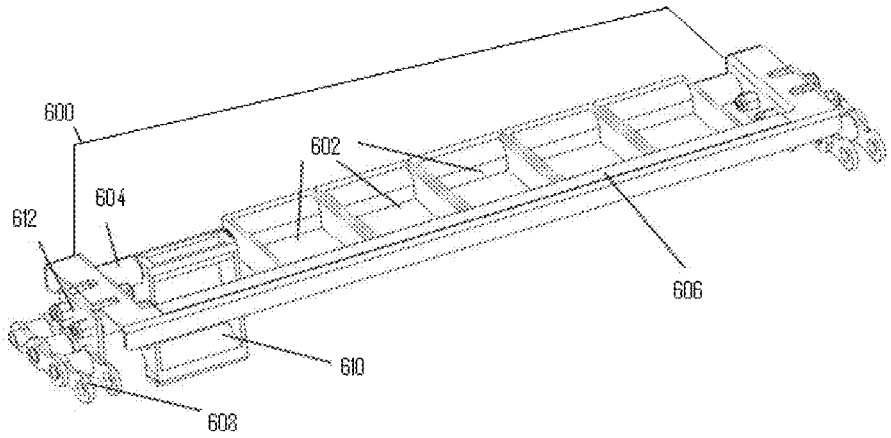

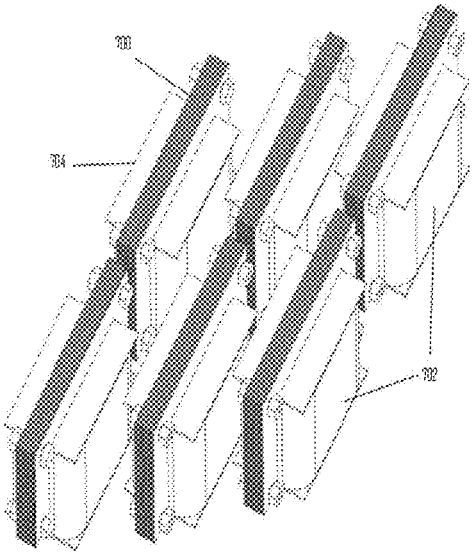
FIG. 7
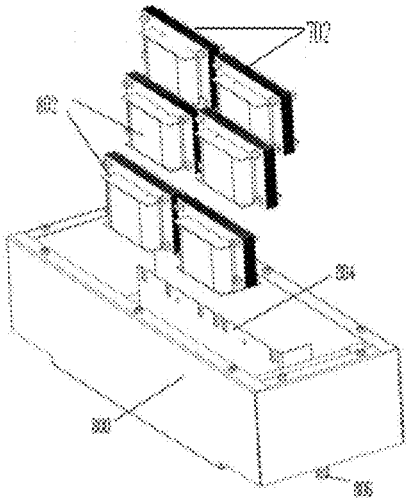
FIG. 8
FIG. 9
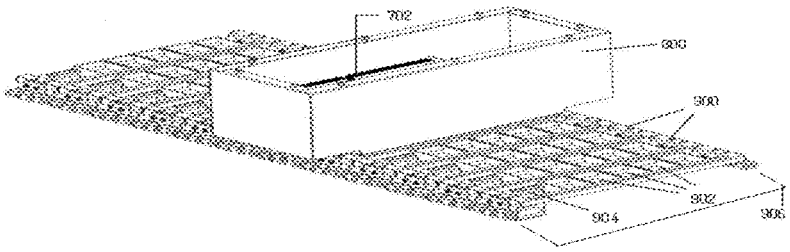

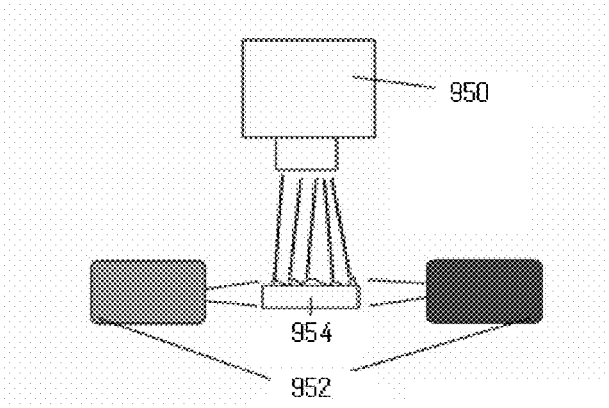
FIG. 10
FIG. 11
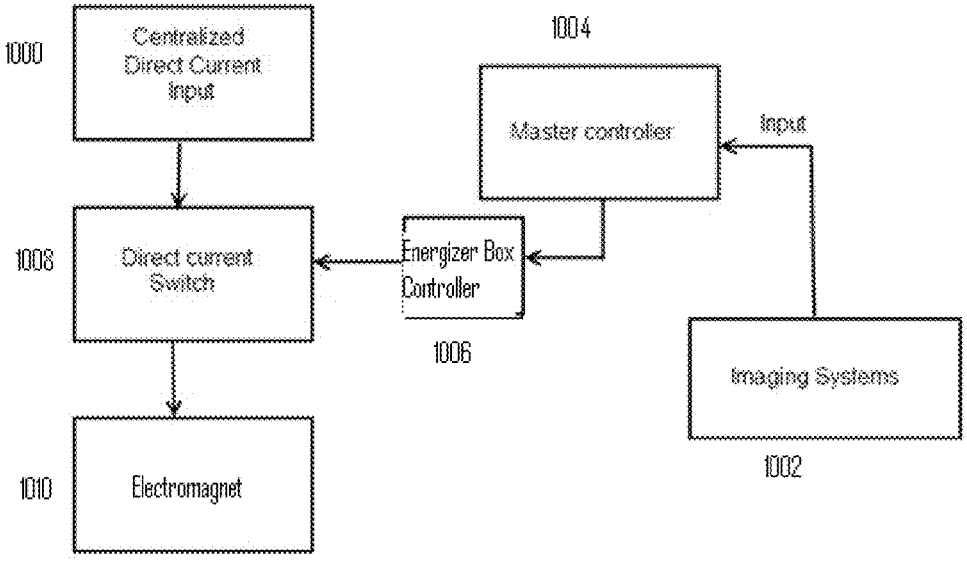

MACHINE FOR GRADING SMALL SIZED IRREGULAR OBJECTS AND A PROCESS THEREOF

FIELD OF THE INVENTION

The present invention relates generally, to a grading machine for grading small sized irregular or uneven objects by size, color, shape and surface finish into various grades, and more particularly, relates to an improved grading machine for grading small sized irregular or uneven objects, which is provided with imaging systems having multi-vision system aided with multi-wavelength lighting system for surface property extraction for a given object of interest and an embedded intelligence system for automated, intelligent grading operation. The present invention also describes a process for grading small sized irregular or uneven objects using an electronically controlled non-contact mechanism.

BACKGROUND OF THE INVENTION

Grading of different objects according to their size, shape, color and surface properties is a very important criterion for evaluating quality of any object of interest. For an instance, if we consider tree nut which is an expensive agricultural product and the prices depend on its quality. Such expensive agricultural products, not limited to tree nuts, are an important commercial commodity that plays a major role in earning foreign currency among export commodities. To ascertain the quality, it becomes indispensable to grade such objects to meet grading standards in quick, easy and accurate manner for accurate grading as well as to save time for performing fine grading operations.

With the advent of modern technologies, consistent efforts are being made to improve an existing grading machines for grading different types of objects in a time efficient and effective manner. In order to improve the existing grading machines, various technologies have been introduced as described herein below in a few patent documents:

U.S. Pat. No. 6,956,644 titled "Systems and methods for a wafer inspection system using multiple angles and multiple wavelength illumination" discloses an optical surface inspection using a light collection optics for inspecting semiconductor wafers, mask substrates, and other similar articles. PCT Publication No. WO 1997012226 titled "Improved system for surface inspection" discloses an apparatus and a method for detecting anomalies of surfaces by providing a scanning means which causes the surface to move so that the beam scans the surface along a spiral path. Indian Application No. 1044/MUM/2002 describes relates to a takeout mechanism for gripping a bottle. U.S. Pat. No. 5,807,419 proposes a combined blow head and takeout mechanism. U.S. Pat. No. 4,892,183 discloses a dual take out mechanism which functions to alternately remove bottles from the blow station placing half on one output conveyor and the other half on a second output conveyor. According to PCT Publication No. WO2004074107A1 titled "Pick and place assembly for continuously packaging articles", one aspect of the invention provides a pick and place assembly for continuously transferring product from a supply and loading said product into packaging receptacles. According to EP Patent No. 1300609B1 titled "Cam apparatus and pick and place apparatus utilizing the same", the invention relates to a cam mechanism having a simple cam curve, as well as a pick and place apparatus using the cam apparatus. U.S. Pat. No. 3,230,305 titled "Processes and apparatus for the automatic inspection and segregation of articles" relates to the inspection of objects for defects using camera means which discloses an apparatus for electronically inspecting elongated bobbins of yarn comprising image converter means for electronically scanning optically a bobbin of yarn and providing video output signals representing the results of the scan. U.S. Pat. Nos. 4,232,336 and 4,240,110 describe detection of irregularities in crimped fiber. EP Patent No. EP0284630B1 titled "Method for detection of surface defects", which relates to a method for inspecting the surface of a moving metal. EP Patent No. EP0691273B1 relates to invention to an automated inspection system for inspecting packages to verify the presence therein of a product being packaged.

Indian Patent Application No. 340/CHE/2012 titled "Small size irregular object grading machine" discloses a grading machine comprising rotating drum with simple thru holes and using alternating current to supply to the electromagnets, but the current makes the grading machine more time consuming, and the machine uses composite light being thrown on the object of interest making imaging systems of the invention less efficient in analyzing surface anomalies of the object of interest for grading operation.

Different prior art documents described hereinabove related to different grading machines and processes for such grading provide many advantages for effective grading of any small or large sized objects of interest. However, these inventions of prior art exhibit many disadvantages or drawbacks pertaining to grading of small sized, irregular objects such as the machines and related processes of grading have complex mode of operation, less number and variety of objects that can be graded, less time-efficient, not fully automated thereby labor-dependent, and imprecision due to small and irregular sized objects etc. making these inventions less efficient for rapid and accurate grading of any such object of interest.

The present invention addresses the need to develop an improved grading machine and a process for grading small sized, irregular or uneven objects rapidly, more accurately and grades maximum number and variety of objects with enormous precision. Therefore, it would be desirable to provide an improved, intelligent grading machine and related process for grading small sized, irregular objects, wherein such machine and grading operation using such machine is rapid, electronically controlled, labor-efficient and effective in grading maximum number and variety of objects precisely.

SUMMARY OF THE INVENTION

The present invention recognizes and addresses various disadvantages and drawbacks of prior art grading machines and related processes of grading small sized, irregular objects of interest. The present invention has been devised in the light of above mentioned circumstances and aims to solve the above mentioned problems.

In accordance with one aspect of the invention, disclosed is an improved grading machine for grading small sized, irregular objects in an intelligent way to get maximum grading efficiency.

The improved grading machine in which objects are fed in a main hopper, from there they are linearly agitated at a suitable speed by a vibrator to a feeding regulator. The feeding regulator serves the function of regulating the flow of objects by a rotating set of flaps alongside to the direction of the flow of the objects. These objects further slide to a slider, from the slider these objects fall on a set of contrary rotating flaps of a feeding unitary setup that prevent the bulk flow of the objects to a tilted reverse roller pairs thrusting upwards. The reverse roller pairs assembly having two sets of reverse roller pairs, one set thrusting upwards and another set thrusting inwards. The objects are picked quickly by a rotating drum of a pick and place assembly and dropping of the objects synchronous to the conveyor motion on to the cups of cup assembly. Due to embedded magnet present in each cup of the cup assembly, it adheres to the tray of the tray assembly while the tray assembly itself forms the conveyor and the conveyor is in motion. One by one the objects are placed in the assembly of transparent cups enabling the observation of a single given object from different sides by the imaging systems of the grading machine. These imaging systems are programmed in such a way that they can see multiple sides of the single given object of a single cup, decides the category of that object and send the parameters, signals/input to an electronic main master controller of an embedded intelligence system. The embedded intelligence system comprising a main master controller receives parameters, signals from two imaging systems and the main master controller intelligently decides the logic, remembers the position of one category of the object in the cup of cup assembly on the conveyor and sends parameters, signals to the electronic energizer box controller of energizer box assembly and any cup of the cup assembly bearing the desired object can be opened automatically.

Each energizer box can eject objects belong to one category based upon the way the parameters, signals which is sent by the electronic main master controller. Thus, objects are categorized into different kinds of objects based on the parameters or signals provided by the imaging systems and one by one there is a controlled opening of the cup from the cup assembly normal to the plane of the conveyor while in motion and making the different kinds of objects or different categories of objects fall in different collecting chutes of a collecting chutes assembly, thus grouping the same kind or same category of objects in one collecting chute of the collecting chutes assembly according to their size, shape, color and surface properties.

In accordance with another aspect of the invention, disclosed is the process for grading small sized, irregular objects in an intelligent way to get maximum grading efficiency in a practical, fast and satisfactory way, and solves the problem of determining quality parameters such as size, shape, color and surface properties of small irregular objects of interest. Accordingly, objects of the present invention are listed below:

It is the main object of the present invention to provide an improved grading machine which grades small, irregular or uneven objects by size, color, shape and surface finish into various grades in an automated, programmed and hence in an easy manner.

It is another object of the present invention to provide an improved grading machine which operates by using embedded intelligence, also having a multi-vision system aided with multi-wavelength lighting for grading statistically distributed small sized irregular objects very much effectively based upon their natural properties and requirements.

It is still another object of the present invention to provide a fast, time efficient and accurate grading process for grading small, irregular objects rapidly, accurately, efficiently and in an automated manner.

It is further object of the present invention to provide a grading machine with an embedded intelligence and multiple imaging systems for maximum accuracy while grading small sized irregular or uneven objects according to the programmed main master controller of the intelligence system.

It is another object of the present invention to provide an improved grading machine which is simpler, safe, reliable, and compact in structure, also shows high automation degree, avoids faults that may occur during manual operation, work-efficient and enhances workers' productivity utilization, and to provide a more usable process for grading small, irregular objects.

It is still another object of the present invention to provide an improved grading machine having multiple imaging systems which uses multi-wavelength light along with composite light incident on the surface of the objects to determine accurate surface properties of the objects, wherein the light reflected to the imaging systems and the imaging systems can determine the reflection points and construct a profile thus creating a profile map of the surface of the objects.

It is further object of the present invention to provide an improved machine and process which grades and differentiates objects based upon the natural properties and also grading by characteristics of the irregular objects by using plurality of programmed imaging systems having multi-wavelength lighting and multi vision system, wherein the multi-vision system makes the machine to view the object from different angles and sides to determine parameters of the objects for accurate grading of the objects.

It is another object of the present invention to provide an improved grading machine with rotating drum having multiple contoured holes on rotating drum for efficient picking and dropping of the object.

It is still another object of the present invention to provide a grading process for grading small, irregular objects, wherein any cup of the cup assembly possessing object of interest can be normally opened without being physically touched by any means when the conveyor is in motion making it a speedy, fully automated, accurate, and efficient process for grading such objects.

It is further object of the present invention to provide a cost effective, less complex grading machine and the process of such grading by using direct current switches instead of alternating current switches resulting in faster switching time, presenting next cup bearing object to the electromagnet immediately making faster speed of the conveyor for efficient increasing the machine capacity to grade such objects to a maximum extent when compared with the existing grading machines in practice as the electromagnets of an energizer box are powered directly by direct current instead of alternating current with rectifier coupled with the capacitor. This enables to increase the speed of the conveyor also the performance of the energizer box of the energizer box assembly.

It is another object of the present invention to provide an improved grading machine which is favourable for industrial unit to sell the products that are uniform in appearance, and defect free. The process of grading also therewith enhances the processing capability of the products by isolating them from their non-natural class.

It is still another object of the present invention to provide an improved grading machine having multiple imaging systems for multi-vision for a given object to examine the properties of the object of interest and expelling the cup normal to the motion of the conveyor thus accumulating the analogous type of objects to separate collecting chutes of a collecting chutes assembly and further such objects get collected in separate collection units.

It is further object of the present invention to provide an improved grading machine having a reverse roller pairs assembly comprising two sets of reverse roller pairs, wherein each roller pair rotates in opposite direction at high speed. One set of reverse roller pairs thrust inside and another set of reverse roller pairs thrust upwards or outside. The area of interest is the set of reverse roller pairs that thrust upwards/outside where the friction is minimal and hence the objects descend and maintain the queue for the singularly pick up by the rotating drum of a pick and place assembly. The reverse roller pairs that thrust upwards or outside further comprising a set of sensory input which works in connection with the electronic main master controller which intelligently decides the flow of the objects to the reverse roller pairs assembly.

BRIEF DESCRIPTION OF THE DRAWINGS

Other objects, features, and advantages of the invention will be apparent from the following description when read with reference to the accompanying drawings. Drawings are illustrated with different views according to different embodiments of the invention:

FIG. 5 is a schematic view illustrating structural arrangement of a cup according to the present invention.

FIG. 6 is a schematic view illustrating a tray assembly according to the present invention.

FIG. 7 is a top schematic view illustrating an electromagnet assembly according to the present invention.

FIG. 8 is a schematic view illustrating an electromagnet assembly in an energizer box according to the present invention.

FIG. 9 is a schematic view illustrating an energizer box assembly on the conveyor according to the present invention.

FIG. 10 is a schematic view illustrating imaging system having multi-wavelength lighting and multi-vision system according to the present invention.

FIG. 11 is a diagram illustrating layout for switching according to the present invention.

DETAILED DESCRIPTION OF THE PREFERRED EMBODIMENTS

Figure 1:
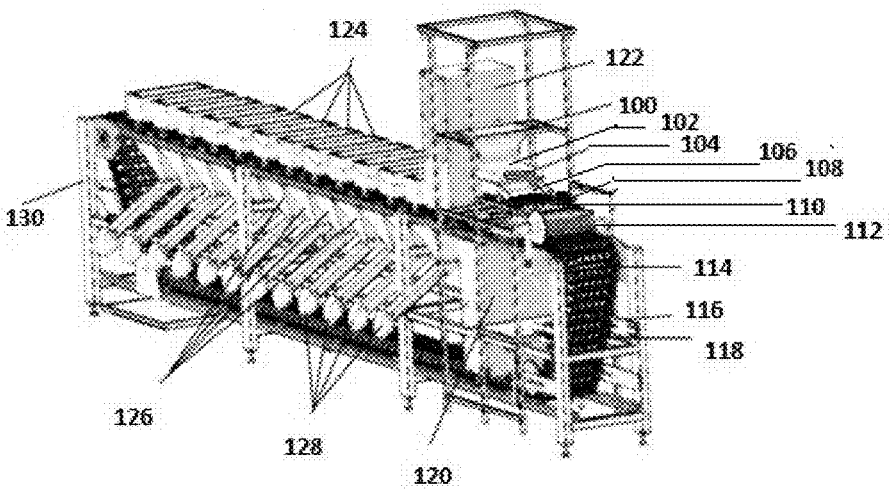
FIG. 1 is a schematic view illustrating an improved grading machine according to the present invention.

The embodiments of the present invention include an improved grading machine for grading small sized irregular objects and a process for grading small sized irregular objects.

As used herein, the term "object" shall refer to any irregular, uneven material including, but not limited to, almonds, raisins, cloves, walnut, pistachios, cashew nuts, or can be all culinary nuts, dry fruits, groundnuts, cardamom, and other irregularly shaped objects like diced vegetables. The objects can be any object naturally occurring or synthetically manufactured object sizing in the range of 5 to 75 mm. The machine is capable of grading it based on the object's properties. As used herein, the objects at large refer to but not limited to agricultural products within the size range mentioned as above.

As used herein, the term "small sized" shall refer to any statistically distributed objects that do not exceed the dimensional tolerances of 5 to 75 mm measured at extreme ends along all sides of the object. This range of 5 to 75 mm dimension also refers to "minimum tolerance of dimension".

As used herein, the term "electromagnet" refers to energizers or coils producing strong impulsive magnetic force.

As used herein, the term "imaging systems" refer to multiple cameras placed into the unit for observing any object from different angles.

As used herein, the term "irregular or uneven" shall refer to any naturally occurring or synthetically manufactured object in the size range of 5 to 75 mm measured across at the extreme ends of that material.

As used herein, the term "embedded intelligence system" shall refer to a main master controller linked with grading machine and functioning of grading machine which functions intelligently, so can remember and identify same object when needed for further operation and controls electronically the grading machine using electronically controlled non-contact mechanism to grade a small sized, irregular or uneven objects with accuracy.

As used herein, the term "multi-vision" shall refer to multiple camera based inspection. There can be multiple cameras to analyse the same object from various angles and regions of interest.

As used herein, the term "multi-wavelength" shall refer to the light incident on the object for analysis is not just white light but a combination of various different wavelengths of the spectrum. "Multi-wavelength" can be any colour in the visible spectrum coupled with white light. It also refers to multiple-monochromatic source of radiation ranging between infrared and visible light.

Referring now in more detail to the exemplary drawings for purposes of illustrating embodiments of the invention, wherein like reference numerals designate corresponding or like elements among the several views.

In one embodiment of the present invention the invention details out an improved grading machine for grading small irregular objects which grades small, irregular objects by size, color, shape and surface finish into various grades, specifically illustrated for cashew kernels but not limited to cashew kernels in this invention into grades like W180, W320 etc. in an automated and programmed way.

Referring to FIG. 1, it is a schematic view illustrating an improved grading machine according to the present invention. A main hopper (100) is an asymmetric inverted asymmetric pyramidal shaped in which small sized, irregular objects are fed and from there they are linearly agitated at a suitable speed by a vibrator (102) to a feeding regulator (104). The feeding regulator (104) regulates the flow of objects by a rotating set of flaps alongside to the direction of the flow of the objects. These objects further slide to the slider (106) and from slider (106), these objects fall on a set of contrary rotating flaps of a feeding unitary setup (108) that prevent the bulk flow of the objects to the tilted reverse roller pairs assembly (110). The reverse roller pairs assembly (110) comprising of two sets of reverse roller pairs rotate in opposite direction. One set of reverse roller pairs thrusting upwards direction and another set of reverse roller pairs thrusting inwards. The set of reverse roller pairs thrusting upwards at high speed with the key prominence on the upkeep of the queue coupled with the set of contrary rotating flaps of a feeding unitary setup (108) that prevent the bulk flow of the objects overdue the other for singularity pickup by the rotating drum (112) of a pick and place assembly on the moving conveyor (114). Once the objects are made to fall into the set of reverse roller pairs thrusting upwards, due to low friction the objects slide and maintain the queue until they are singularly picked and synchronously placed by the rotating drum (112) of the pick and place assembly on the moving conveyor (114). The rotating drum (112) is having multiple numbers of contoured holes enabling faster pick up and dropping of the objects synchronous to the conveyor (114) motion. The set of reverse roller pairs thrusting upwards has a set of sensory input located on it. This set of sensory input connects to the electronic main master controller which senses the presence of the object and thus intelligently regulates the flow of objects falling onto the set of reverse roller pairs thrusting upwards.

Active pick and place of the objects onto the cups of cup assembly, wherein each cup assembly (118) comprises an array of cups arranged in each tray of the tray assembly (116). Each cup from the cup assembly (118) has an embedded magnet in it and such cup adheres to one tray of the tray assembly (116) while the tray assembly (116) itself forms the conveyor (114) and the conveyor (114) is in motion. Each cup bearing desired object placed in any cup of the cup assembly (118) can be opened automatically. One by one the objects are placed in the cup assembly (118) which is made up of array of transparent cups wherein each cup of the cup assembly (118) provide the facility for multi-vision of a single given object.

The tray assembly (116) is a set of multiple trays placed side by side parallel to one another. Each tray of the tray assembly (116) is a set or assembly of multiple numbers of transparent cups forming a cup assembly (118). Such multiple numbers of cups are located in one tray of tray assembly, and these multiple numbers of cups make one cup assembly (118). The cups of the cup assembly (118) are transparent and are made up of acrylic or any such other transparent material. Objects are placed One by one in the assembly of transparent cups (118) which provide the facility for multi-vision of a single given object, identifying the type- and controlled opening of the cup from the cup assembly (118) normal to the plane of the conveyor (114) while in motion. The conveyor (114) is made up of tray assembly (116), wherein each tray of the tray assembly (116) is made up from a stainless steel material.

There can be multiple imaging systems which can be operated in the improved grading machine. According to FIG. 1, two imaging systems (120 and 122) are shown which are mounted on main frame (130) of the improved grading machine. The imaging systems (120 and 122), are set in such a way that they see multiple sides of the same object and decides the type and sends the signal to the electronic main master controller of the embedded intelligence system. The grading machine have multiple cameras in multiple imaging systems (120 and 122) and from various angles, these multiple imaging systems (120 and 122) work making them multi-vision imaging systems. Each camera looks at a specified area of the object and will analyse for the defined parameters. The improved machine comprises multiple electronic energizer boxes forming the energizer box assembly (124) mounted to the main frame (130). Each energizer box of energizer box assembly (124) has the electro-magnet with control in them and energizer box controller. Each cup of the cup assembly (118) can be individually opened and they are electronically actuated into different collecting chutes (126). Each cup of the cup assembly (118) is opened by energizing the electromagnet located in the energizer box of energizer box assembly (124) from a distance which is actuated by the electronic main master controller; the main master controller which can be in the energizer boxes (124) or can be separately placed in any box anywhere in the machine, collects the parameters from two imaging systems placed in (120 and 122) and intelligently decides based on parameters, signals/input sent to it to energize the electromagnet which is placed in multiple energizer boxes of energizer box assembly (124). As each energizer box of the energizer box assembly (124) comprises the electromagnet with control in them and energizer box controller, hence each energizer box can eject one kind of objects based upon the way the parameters, signals provided by the electronic main master controller.

The improved grading machine has a multi-vision system and the embedded intelligence system comprising the electronic main master controller. The main master controller receives signals from two imaging systems (120 and 122), and it intelligently decides the logic and sends parameters, signals to the electronic energizer box controller located in the energizer boxes of the energizer box assembly (124). As soon as the signal is received from the electronic main master controller, the energizer box controller triggers the electronic direct current switch when the respective cup arrives in position, thus making the electro-magnet to get energized and the electromagnet repels the underlying embedded magnet in the cup of the cup assembly (118) and thus the object inside it falls into one collecting chute of collecting chutes assembly (126) and the object or objects pass through the channels (128) to the respective collection units.

One by one the objects are placed in the assembly of transparent cups (118) which provide the facility for multi-vision of a single given object, identifying the type and controlled opening of the cup from the cup assembly (118) normal to the plane of the conveyor (114) while in motion and making the placed objects fall in different collecting chutes of collecting chutes assembly (126), thus grouping them according to their properties thereby grading objects of different categories using the improved grading machine.

Figure 2:
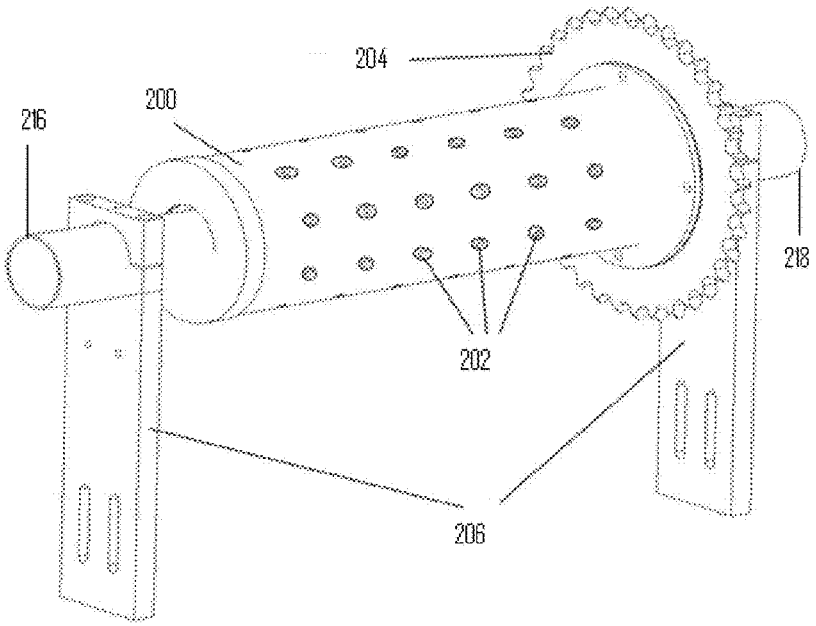
FIG. 2 is a schematic view illustrating a pick and place assembly according to the present invention.

Referring to FIG. 2, it is a schematic view illustrating pick and place assembly according to the present invention. It illustrates the pick and place assembly comprises a rotating drum (200) with multiple contoured holes (202) on the circumference along the length of the rotating drum (200), the either ends of the drum (216 and 218) are connected to a pump from which the air is drawn at high rate and by doing this, there is partial vacuum created near the surface of the rotating drum (200).

Figure 3:
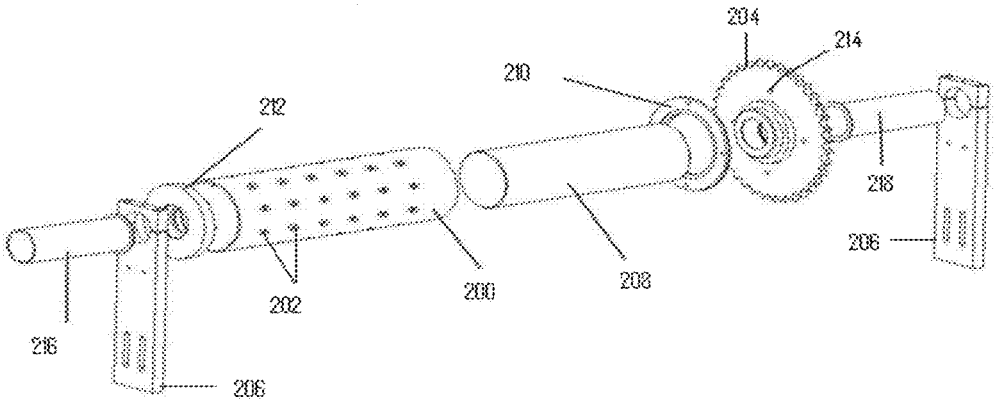
FIG. 3 is an exploded schematic view illustrating a pick and place assembly according to the present invention.
Figure 3A:
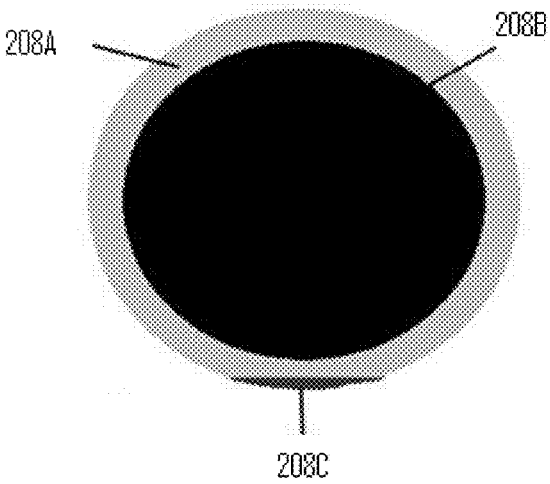
FIG. 3A is an elaborated view of part 208 of FIG. 3 according to the present invention showing the compression of the soft material.

Referring to FIG. 3, it is an exploded schematic view illustrating the pick and place assembly according to the present invention and FIG. 3A is an elaborated view of part 208 of FIG. 3 according to the present invention showing the compression of the soft material. FIG. 3A shows a blown up diagram of the pick and place assembly. The diagram shows the arrangement of pick and place assembly and functioning in terms of picking and placing the objects. FIG. 3 shows a vacuum rotating drum (200) with multiple contoured holes (202) on the circumference along the length of the rotating drum (200), the either ends (216 and 218) of the rotating drum (200) are connected to a pump from which the air is drawn at high rate and by doing this, there is partial vacuum created near the surface of the rotating drum (200). Rotating drum support flange (210) bears holes or slots to which sprocket (204) is affixed with the help of rotating drum mounting hole (214) present on the sprocket (204). Rotating drum cover flange (212) is another means to fix rotating drum (200) to one end (216) of the rotating drum (200). The rotating drum (200) of pick and place assembly internally comprises a heavy, cylindrical, solid roller (208) which is coated with a soft material (208A) and the roller rotates inside the rotating drum (200) in a non-concentric axis. As the outer surface of the solid roller (208B) is coated with a soft material (208A), the soft material gets compressed at the bottom of the rotating drum (208C) due to self-weight of the solid roller (208) closing the rotating drum hole (202) locally. When the hole (202) is closed from inside, there is no suction happening from those holes (202) thus making the objects which have adhered to the rotating drum (200) fall down due to self-weight & gravity. This entire process happens while the rotating drum (200) is rotating thus the objects are picked up from the maintained queue and placed on the conveyor (114) one after another synchronously. Object fall synchronously on the conveyor (114) which has been adhered due to Bernoulli force as well as vacuum force now forced to fall by gravity and self-weight. The soft material can be natural rubber, silicone, polyurethane, foam rubber, nitrile rubber, neoprene, elastomers etc.

Figure 4:
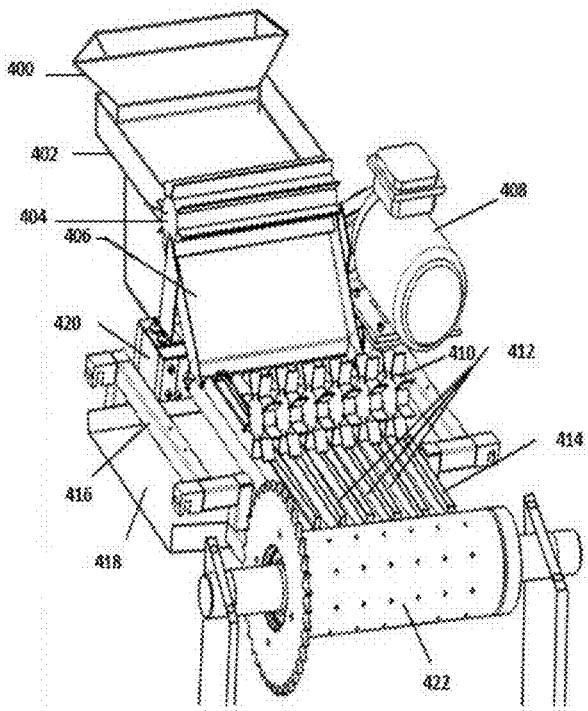
FIG. 4 is a schematic view illustrating a feeding assembly according to the present invention.
Figure 4A:
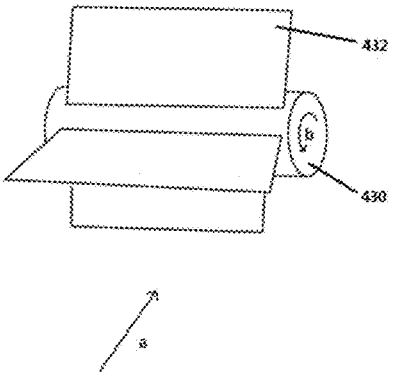
FIG. 4A is a schematic view illustrating an elaborated schematic view of a feeding regulator which is a part of the feeding assembly of FIG. 4 according to the present invention.
Figure 4B:
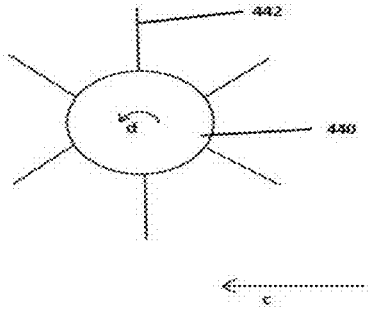
FIG. 4B is a schematic view illustrating an elaborated schematic view of a feeding unitary setup which is a part of the feeding assembly of FIG. 4 according to the present invention.

Referring to FIG. 4, it is schematic view illustrating a feeding assembly according to the present invention. FIG. 4A is a schematic view of a feeding regulator and FIG. 4B is a schematic view of a feeding unitary setup, wherein FIG. 4A and FIG. 4B are parts of the feeding assembly of FIG. 4 which describes the functioning of the entire feeding assembly. The feeding assembly comprises mainly a main hopper (400), a vibrator (402), a feeding regulator (404), a slider (406), a feeding unitary setup, (410), a reverse roller pairs assembly (412) and a set of sensory input. The main hopper (400) is provided for feeding small sized, irregular or uneven objects. These objects are linearly agitated by the vibrator (402). The descending of the objects is regulated by the feeding regulator ((404) which fall on the slider (406). From slider (406), the objects further slide on the feeding unitary setup (410) and from the feeding unitary set up (410) further objects fall on the reverse roller pairs assembly (412). The reverse roller pairs assembly (412) comprises of two sets of reverse roller pairs, one set of reverse roller pairs which are thrusting upwards or outside which is the area of interest and another set of reverse roller pairs which are thrusting inwards or inside. Each reverse roller pairs of both sets of reverse roller pairs assembly rotates in opposite direction at high speed. To cover the set of reverse roller pairs that are thrusting inside, a covering (414) is placed. The covering (414) is to prevent the objects falling on the set of reverse roller pairs that are thrusting inside.

FIG. 4A is an elaborated schematic view of a feeding regulator (404) part of FIG. 4. The feeding regulator (404) is placed below the vibrator (402) and above the slider (406). The feeding regulator (404) which has a set of flaps (432) rotating alongside the direction of the flow of the objects which move further to the reverse roller pairs assembly (412). The direction of feeding of objects is indicated by 'a' and direction of rotation of the set of flaps (432) is indicated by 'b'. The feeding regulator regulates optimal feeding of the objects.

FIG. 4B is an elaborated schematic view of a feeding unitary setup (410) part of FIG. 4. The feeding unitary setup (410) is made up of the unitary hub (440) and a set of flaps (442) which rotate (d) in the contrary direction of the flow of the objects (c). The feeding unitary setup (410) has a set of flaps (442) which are made up of plastic like material which is flexible yet rigid that prevent the bulk flow of the objects (c) overdue the other for singularity pickup by the rotating drum of the pick and place assembly (422). The set of reverse roller pairs of the reverse roller-pairs assembly (412) which is thrusting upwards at high speed with the key prominence on the upkeep of the queue coupled with a set of contrary rotating flaps (442) of the feeding unitary setup (410). The up thrusting reverse roller pairs of reverse roller pairs assembly (412) have a gap matching the minimum tolerance of dimension of object and objects smaller than that fall through the gap while objects within the dimensional tolerance (less than 5 mm) forms a queue ready to be picked-up. The set of reverse roller pairs thrusting upwards have a set of feeding unitary setup (410) coupled with the set of sensory input to the electronic main master controller to regulate the feeding unitary setup (410) and the feeding regulator (404) for optimal feeding of the objects. The set of sensory input is linked to the electronic main master controller which intelligently decides the flow of the objects to the set of reverse roller pairs thrusting upwards of the reverse roller pairs assembly (412).

All reverse roller pairs of the reverse roller-pair assembly (412) are connected through a gear train, so all the reverse roller pairs rotate in opposite direction. The only difference in rotation is that one set of reverse roller pairs thrust inside and another set of reverse roller pairs thrust outside. The set of reverse roller pairs that thrust outside is the main area of interest in the present invention. That's where the friction is minimal and hence the objects descend and maintain the queue for the pickup. The entire gear train is powered by the external motor (408). The reverse roller frame (416) is located in the feeding assembly for holding reverse roller pairs assembly (412). On the reverse roller pairs assembly (412) where the set of reverse roller pairs thrusting upwards or outside is located, the objects maintain the queue behind the rotating drum (200) of the pick and place assembly (422). Each pair of reverse roller pairs in the reverse roller pairs assembly (412) is rotated in up thrusting reverse direction by a gear box (420) and the reverse roller pairs which rotate in the same direction are the non-working zones and they are covered from top alternatively (414). The covering (414) is for the inward thrusting rollers. The purpose of the set of up thrusting reverse roller pairs of the reverse roller pairs assembly is also to eliminate the tiny or broken objects by size i.e. objects that are too tiny or broken, fall between theses reverse roller pairs on to the collection plate (418) these are not fed on the tray assembly (116). The reverse roller pairs of the reverse roller pairs assembly (412) are rotated by an external motor (408). The rotation of the reverse roller pairs thrusting upwards or outwards of the reverse roller pairs assembly (412) will queue the objects behind the pick and place assembly (422), they will be picked up when they come in the vacuum zone and get drawn towards the rotating drum of the pick and place assembly (422), they adhere to the rotating drum since the hole size is smaller than the object. The entire unit of the vacuum pick and place rotating drum (200) in the pick and place assembly (422), is rotated externally synchronous to the motion of the conveyor (114) by the sprocket (204), In the course of rotation; the objects are singularly picked up due to Bernoulli & partial vacuum force generation near the surface of the rotating drum (200) of the pick and place assembly (422).

Referring to FIG. 5, it is a schematic view illustrating structural arrangement of a cup according to the present invention. The diagram shows internal structure of one cup of cup assembly. Such cup assembly makes one tray, multiple number of trays mounted parallel to one another makes a tray assembly and the tray assembly itself makes the conveyor. The cups are transparent cups and are made up of acrylic material. Cup (500) is showing different parts which make up one cup (500). Cup has an embedded magnet (502) in it which is meant for adhering the cup (500) to the tray. A magnetic clip (504) is provided for enclosing the cups of cup assembly. Cups are fixed on tray assembly at one side through cup hole (506) for axis rod. This axis rod is a part of one tray of tray assembly. Visible area of the cup (508) which is the area of interest for imaging systems for the cup (500) can be normally opened without being physically touched by any means and open-able normal to the motion of the conveyor.

Referring to FIG. 6, it is a schematic view illustrating a tray assembly according to the present invention. The diagram shows the tray assembly of the improved grading machine. Multiple numbers of cups make cup assembly (602) in one tray (600). Such cup assembly comprises multiple numbers of cups which are arranged parallel to one another to form one tray and the axis of the cup (604) is normal to the tray (600). The cups of the cup assembly (602) possess an embedded magnet (502) in them and adhere to the tray (600) via a touch plate (606). The tray (600) is linked on chain links (608) with the help of tray mounting fasteners (612) while the multiple number of tray (600) forms tray assembly and such tray assembly links multiple number of trays via chain links (608) forming the conveyor (114). Tray assembly is the assemblage of multiple numbers of trays located parallel to one another makes conveyor (114). The touch plate (606) is a part of the tray (600) which is magnetic in nature for each cup of the cup assembly (602) to be held in the tray (600). One cup (610) of the cup assembly opens automatically keeping the position of other cups of the cup assembly normal.

Referring to FIG. 7, it is a top schematic view illustrating an electromagnet assembly according to the present invention. The diagram shows an electromagnet assembly. The electromagnet assembly consists of an array of electromagnet (702) comprising a bobbin (704) and a magnetic core (700). The array of electromagnet (702) is placed in a pattern such that the magnetic field does not interfere with the adjacent cups of the cup assembly (602). The electromagnets from array of electromagnets (702) are of non-standard size and are optimized specifically for the application, the reduced size of the bobbin (704) and the usage of magnetic core (700) material reduces the interference less than that of two adjacent cups thus enabling ejection of only one desired cup (610) of a cup assembly (602) in a tray (600).

Referring to FIG. 8, it is a schematic view illustrating an electromagnet assembly in one energizer box of an energizer box assembly (124). Accordingly, the improved machine comprises multiple energizer boxes forming the energizer box assembly (124) mounted to the main frame (130). Each energizer box of the energizer box assembly (124) has an array of electromagnets with control in them and an energizer box controller, hence each energizer box can eject one kind (category) of objects based upon the way the parameters, signals are provided by the main electronic master controller. One energizer box (800) primarily consists of the electromagnet assembly made up from the array of electromagnets (702) and the energizer box controller. The array of electromagnets (702) placed in the energizer box (800) in a pattern such that the magnetic field does not interfere with the adjacent, opened cup (610). The array of electromagnets (702) comprising of a pair of electromagnet (802). Each pair of electromagnet (802) is separated by a wall (804), which serves the purpose of proper mounting of the electromagnet (802) in the energizer box (800). The energizer box controller triggers the direct current switch and by doing so the electromagnet (802) get energized and magnetized, this repels the magnet in the cup (610) of cup assembly (602) allowing the ejection of only one desired cup (610) of a cup assembly (602) in a tray (600). The entire cup opening mechanism is electronically controlled non-contact mechanism, the main master controller sends the parameter based upon the imaging systems output to the energizer box controller which is placed in the energizer box (800) via incoming signal cable (806).

Referring to FIG. 9, it is a schematic view illustrating an energizer box assembly on the conveyor. Accordingly, one such energizer box (800) of the energizer box assembly is shown in the diagram. The energizer box (800) is mounted on the conveyor (900). The electromagnet assembly consisting of an array of electromagnets (702) mounted in the energizer box (800). The cups are arranged side by side (parallel to one another) forming a cup assembly (902) in the tray (906). The energizer box controller located in the energizer box (800) triggers each switch individually and based upon which the electromagnet (802) from the array of electromagnets (702) get energized, the electromagnet (802) opens only one cup (904) retaining the position of the adjacent cups of the cup assembly (902). From a distance, the electromagnet (802) when energized shall repel the embedded magnet in the cup (904) thus making the cup (904) to open naturally. The entire ejection of only one desired cup bearing desired object happens while the tray (906) is in motion on the conveyor (900) which is made of tray assembly. The entire mechanism is automated and is synchronous to the conveyor (900) motion. The speed of the conveyor (900) is a factor of number of trays per second. The conveyor (900) speed can speed up to 16 trays per second.

Referring to FIG. 10, it is a schematic view illustrating imaging system having multi-wavelength lighting and multi vision system according to the present invention. One imaging system (960) is shown schematically in FIG. 10. The imaging system, (960) is provided with multi-vision system (950) aided with multi wavelength lighting systems (952) for extraction of surface properties from the image for a given object (954) and to analyze the properties of the object (954) from multiple directions. Multi wavelength lighting system (952) work due to differential lighting grazing the surface, differential reflections are created by the anomalous surface and are seen and analyzed by the imaging system. All the cameras of multi-vision system (950) will send the parameters, signals to the electronic main master controller which is a part of the embedded intelligence system and the main master controller makes a decision based on the parameters, signals/input and work for the required output.

Referring to FIG. 11, it is a diagram illustrating layout for switching according to the present invention. It details out how the entire mechanism of grading small, irregular sized objects by the improved grading machine takes place automatically using electronically controlled non-contact mechanism. The improved grading machine operates according to the electronically controlled non-contact mechanism using embedded intelligence system and imaging systems having multi-wavelength lighting (952) and multi-vision system (950). The imaging systems (1002) analyse properties of the object and sends the parameters, signals to the main master controller (1004) of the embedded intelligence system. The main master controller (1004) that receives the parameters, signals from the imaging systems (1002), remembers the position of one category of object (954) present in the cup of the cup assembly on the conveyor (900), the main master controller (1004) is intelligent enough that it remembers the position of the object (954) and sends parameters, signals to the electronic energizer box controller (1006) present in the energizer boxes of energizer box assembly when the object reaches the exact location on the conveyor. The energizer box controller (1006) triggers the direct current switch (1008) to energize and magnetize the electromagnet (1010) present in energizer box. Energizing and magnetizing the electromagnet repels the embedded magnet in the cup of cup assembly when same, identified object bearing cup reaches the exact location on the conveyor thus making the cup bearing an identified object to open naturally and the cup opening is normal to the plane of the conveyor while in motion and making the objects place in different collecting chutes of collecting chutes assembly for grading and grouping same sized, irregular objects finally in different collection units. The entire cup opening/cup ejection mechanism is electronically controlled non-contact mechanism, automated and synchronous to the conveyor motion. The improved machine is capable of grading it based on the properties of the objects.

The machine is effective for the sake of grading viz., unlike other conventional grading machines, the small sized irregular or uneven objects grading machine uses RGB based Imaging systems with algorithms that are designed for very fast turn-around time.

In second embodiment of the present invention, a process for grading small, irregular or uneven objects is described. The process of grading uses the above described improved grading machine which grades small, irregular objects by size, color, shape and surface finish into various grades, specifically illustrated for cashew kernels but not limited to cashew kernels in this invention into grades like W180, W320 etc. in an accurate way.

The process includes following steps:

a. providing an improved grading machine;

b. feeding the machine with a small sized irregular or uneven objects in a main hopper of a feeding assembly, wherein the feeding assembly comprises the main hopper, a vibrator, a feeding regulator, a slider, a feeding unitary setup, a reverse roller pairs assembly and a set of sensory input;

c. agitating linearly objects at a suitable speed by the vibrator to the feeding regulator, wherein said feeding regulator regulates the flow of objects by a rotating set of flaps alongside to the direction of the flow of objects;

d. rotating the reverse roller pairs assembly and a pick and place assembly, wherein the reverse roller pairs assembly comprising two sets of reverse roller pairs in which one set of reverse roller pairs thrusting upwards and another set of reverse roller pairs thrusting inwards, and wherein the pick and place assembly comprising mainly a rotating drum having multiple contoured holes along the circumference and a heavy, cylindrical, solid roller which rotates in a non-concentric axis and;

e. sliding the objects further from the feeding regulator to the slider and from slider, these objects fall on aset of contrary rotating flaps of the feeding unitary setup for preventing the bulk flow of the objects from the feeding unitary set upon the set of reverse roller pairs thrusting upwards which is coupled with the set of contrary rotating flaps of the feeding unitary setup maintaining the queue due to low friction, and wherein the set of reverse roller pairs thrusting upwards is coupled with the set of sensory input which is linked to an electronic main master controller of an embedded intelligence system to provide the sensory input to the main master controller which senses the presence of the object thereby intelligently regulates the flow of objects falling onto the set of reverse roller pairs thrusting upwards;

f. allowing the formation of queue behind the rotating drum of the pick and place assembly when the objects come in the vacuum zone and get drawn towards the rotating drum, adhering to the rotating drum as the hole size on the rotating drum is smaller than the objects, wherein the rotating drum is coupled with feedback based the feeding assembly;

g. picking objects singularly by the rotating drum from the maintained queue, further when a soft material coated on outer surface of said solid roller gets compressed at the bottom of the rotating drum due to self-weight of the solid roller closing a rotating drum hole locally from inside, creating lack of suction from the hole, thereby dropping down the object or objects due to self-weight and gravity;

h. collecting the dropped down object or objects in cups of a cup assembly of one tray of a tray assembly one after another synchronously, wherein cups are transparent having the facility for multi-vision of the singularly picked object, thereby help identifying the category of the singularly picked object;

i. scanning the object or objects and sending the parameters or signals by the plurality of imaging systems to the main master controller of the embedded intelligence system;

j. receiving the parameters or signals from the plurality of imaging systems by the main master controller and remembering the position of the single object present in single cup of each tray in said tray assembly on the conveyor, wherein the intelligent operation of remembering a single object or objects is performed by the main master controller;

k. sending the parameters or signals by the main master controller to the energizer box controller when the single object of single cup of each tray in the tray assembly reaches the exact position on the conveyor;

l. triggering the direct current switch by the energizer box controller, for energizing and magnetizing the electromagnet of energizer box controller, thereby repelling the embedded magnet of a single cup of each tray of tray assembly at a time;

m. opening of the cup which is an electronically controlled non-contact mechanism; and n. placing objects from different opened cups in different collecting chutes of collecting chutes assembly and finally get collected into different collection units thus grading them according to their same properties and characteristics.

The entire process of picking and placing of objects take place while rotating drum is in continuous rotation and the objects picked up from the maintained queue and placed on the conveyor one after other synchronously. The objects one by one are placed in the assembly of transparent cups which provide the facility for multi-vision of a single given object, identifying the type and controlled opening of the cup from the cup assembly normal to the plane of the conveyor while in motion and making the placed objects fall in the collecting chutes of collecting chutes assembly thus grouping and grading them according to their properties and characteristics.

As will be readily apparent to those skilled in the art, the present invention may easily be produced in other specific forms without departing from its essential characteristics. The present embodiments is, therefore, to be considered as merely illustrative and not restrictive, the scope of the invention being indicated by the claims rather than the foregoing description, and all changes which come within therefore intended to be embraced therein.

What is claimed is:

1. An improved grading machine for grading small sized irregular or uneven objects comprising:

a. at least one feeding assembly comprising of at least one asymmetric inverted asymmetric pyramidal shaped main hopper for feeding small sized irregular or uneven objects therein, at least one vibrator for linearly agitating objects at a suitable speed to move further from said main hopper to at least one slider coupled with a feeding regulator for optimal feeding of objects, at least one tilted reverse roller pairs assembly comprising at least two sets of reverse roller pairs rotating in opposite direction, wherein one set of reverse roller pairs thrusting upwards and another set of roller pairs thrusting inwards, and wherein said set of reverse roller pairs thrusting upwards at high speed is coupled with a set of sensory input and coupled with a set of contrary rotating flaps of at least one feeding unitary setup maintaining queue of objects due to low friction;

b. at least one pick and place assembly comprising a vacuum rotating drum bearing multiple contoured holes on the circumference along the length of said rotating drum, an inner heavy, cylindrical, solid roller coated with a soft material which rotates in a non-concentric axis, wherein said objects from said queue are singularly picked and synchronously placed by said rotating drum for further processing;

c. a tray assembly comprising plurality of trays placed parallel to one another, wherein each tray of said tray assembly comprises a transparent cup assembly, and wherein each cup of said cup assembly located in said tray has an embedded magnet for adhering to said tray via a touch plate; and further wherein said singularly picked objects are placed by said rotating drum into said cup which provides the facility for multi-vision of said singularly picked object, thereby help identifying the category of said singularly picked object;

d. at least one conveyor, wherein said tray assembly make said conveyor and said tray assembly forms said conveyor by interlinking via chain links;

e. at least two imaging systems having multi-vision system along with multi-wavelength lighting system, wherein said imaging systems are located at different positions in said improved grading machine and are set in such a way to see multiple sides of said object or objects for extraction of surface properties from the image of said object for analysis of properties of said object, once said object is placed in said cup of said cup assembly, decides the type of said placed object and finally send the parameters, signals for further processing;

f. at least one embedded intelligence system comprising an electronic main master controller located in any box anywhere in the machine, wherein said main master controller receives parameters, signals from said imaging systems, remembers the position of single said object when the single object of single cup of each tray in said tray assembly reach the exact position on said conveyor thereby sending said parameters, signals for further processing;

g. at least one energizer box assembly located on said conveyor, wherein said energizer box assembly comprising a plurality of energizer boxes, and wherein each energizer box of said energizer box assembly comprising an electromagnet assembly fixed in said energizer box, an incoming signal cable for receiving signals from said main master controller and energizer box controller; and further wherein said electromagnet assembly comprises an array of electromagnets with magnetic core; and further wherein said energizer box controller triggers the electronic direct current switch individually when the single object of the single cup of each tray reaches the exact position on said conveyor thus making electromagnet of electromagnet assembly to get energized, magnetized, thereby repelling underlying said embedded magnet of said cup; and further wherein each energizer box of said energizer box assembly eject a single cup bearing single object which is of one category of objects based upon the way said parameters, signals are provided by said main master controller;

h. an ejection system comprising said cups of a cup assembly, wherein said cup is only one repelled cup of said cup assembly which is ejecting automatically retaining the position of other cups of cup assembly, thereby dropping said single object of one category into one collecting chute of collecting chutes assembly to get collected finally into one collection unit through channel, thereby grouping and grading said object or objects into different categories into different collecting chutes of a collecting chutes assembly, collected into different collection units based on their size, shape, color and surface properties, and wherein the ejection mechanism is automated, controlled and synchronous which occurs while said conveyor is in motion and said ejection is pre-determined by said imaging systems comprising said multi-vision system along with said multi-wavelength lighting system and said embedded intelligence system; and i. at least one main frame to support all above mentioned elements of said improved grading machine.

2. The improved grading machine according to claim 1, wherein said feeding unitary setup coupled with feedback from said set of sensory input to said main master controller which sense the presence of said objects and intelligently regulate the flow of objects falling onto said set of reverse roller pair assembly.

3. The improved grading machine according to claim 1, wherein said machine has said reverse roller pairs of said reverse roller pairs assembly thrusting upwards have a gap matching the minimum tolerance of dimension of object and objects smaller than minimum tolerance of dimension fall through the gap while objects within the dimensional tolerance forms a queue ready to be picked-up by said rotating drum of said pick and place assembly.

4. The improved grading machine according to claim 1, wherein said set of feeding unitary setup coupled with said set of sensory input to said main master controller to regulate said feeding unitary setup, wherein said feeding unitary setup comprises a set of flaps which rotate in the contrary direction of the flow of the objects and said set of flaps are made up of plastic like material which is flexible yet rigid that prevent the bulk flow of the objects overdue the other for singularity pickup by said rotating drum of said pick and place assembly.

5. The improved grading machine according to claim 1, wherein each transparent cup of said cup assembly is attached to said tray of said tray assembly through a magnet which holds said cup along with the object to be inspected by said multi-vision system.

6. The improved grading machine according to claim 1, wherein said machine comprises multi-vision system having multiple cameras for analyzing the properties of the object of interest and determining the category to which said object of interest is classified.

7. The improved grading machine according to claim 1, wherein said electromagnet assembly comprises an array of electromagnets, a magnetic core, and a bobbin, wherein said array of electromagnets are placed in a pattern such that the magnetic field does not interfere with the adjacent cups of said cup assembly of said one tray of tray assembly and said cup of cup assembly bearing said object of interest normal to the motion of said conveyor at the given location determined by said imaging systems and said embedded intelligence system.

8. The improved grading machine according to claim 1, wherein speed of said conveyor is up to 16 trays per second.

9. A process for grading a small sized irregular objects in grading machine, the steps of the process comprising:

a. providing an improved grading machine of claim 1;

b. feeding said machine with a small sized irregular or uneven objects in a main hopper of a feeding assembly, wherein said feeding assembly further comprises a vibrator, a feeding regulator, a slider, a feeding unitary setup, a reverse roller pairs assembly and a set of sensory input;

c. agitating linearly said objects at a suitable speed by said vibrator to said feeding regulator, wherein said feeding regulator regulates the flow of said objects by a rotating a set of flaps alongside to the direction of the flow of said objects;

d. rotating said reverse roller pairs assembly and a pick and place assembly, wherein said reverse roller pairs assembly comprising two sets of reverse roller pairs in which one set of reverse roller pairs thrusting upwards and another set of reverse roller pairs thrusting inwards, and wherein the pick and place assembly comprising mainly a rotating drum having multiple contoured holes along the circumference and a heavy, cylindrical, solid roller which rotates inside said rotating drum in a non-concentric axis, wherein said solid roller is coated with a soft material;

e. sliding said objects further from the feeding regulator to said slider and from slider, these objects fall on a set of contrary rotating flaps of said feeding unitary setup for preventing the bulk flow of said objects from said feeding unitary setup on said set of reverse roller pairs thrusting upwards which is coupled with said set of contrary rotating flaps of the feeding unitary setup maintaining the queue due to low friction, and wherein said set of reverse roller pairs thrusting upwards is coupled with said set of sensory input which is linked to an electronic main master controller of an embedded intelligence system to provide the sensory input to said main master controller which senses the presence of said objects thereby intelligently regulates the flow of said objects falling onto said set of reverse roller pairs thrusting upwards;

f. allowing the formation of queue behind said rotating drum of said pick and place assembly when said objects come in the vacuum zone and get drawn towards said rotating drum, adhering to said rotating drum as the hole size on said rotating drum is smaller than said objects, wherein said rotating drum is coupled with feedback based said feeding assembly;

g. picking said objects singularly by said rotating drum from said maintained queue, further when said soft material coated on outer surface of said solid roller gets compressed at the bottom of said rotating drum due to self-weight of said solid roller closing a rotating drum hole locally from inside, creating lack of suction from the hole, thereby dropping down said objects due to self-weight and gravity;

h. collecting said dropped down objects in cups of a cup assembly of one tray of a tray assembly one after another synchronously, wherein cups are transparent having the facility for multi-vision of the singularly picked object, thereby help identifying the category of the singularly picked object or objects;

i. scanning said object or objects and sending the parameters or signals by the plurality of imaging systems to said main master controller of said embedded intelligence system;

j. receiving the parameters or signals from the plurality of imaging systems by said main master controller and remembering the position of the single object present in single cup of each tray in said tray assembly on said conveyor, wherein the intelligent operation of remembering a single object or objects is performed by said main master controller;

k. sending the parameters or signals by said main master controller to an energizer box controller when the single object of single cup of each tray in said tray assembly reaches the exact position on a conveyor;

l. triggering the direct current switch by said energizer box controller, for energizing and magnetizing electromagnets of energizer box controller, thereby repelling the embedded magnet of said single cup of each tray of tray assembly at a time;

m. opening of said cup which is an electronically controlled non-contact mechanism; and n. placing objects from different opened cups in different collecting chutes of collecting chutes assembly and finally get collected into different collection units thus grading them according to their same properties and characteristics.

10. The process according to claim 9, wherein the entire said process of picking and placing of said objects take place while said rotating drum is in continuous rotation and said objects picked up from said maintained queue and placed on said conveyor one after other synchronously.

11. The process according to claim 9, wherein said objects one by one are placed in said assembly of transparent cups which provide the facility for multi-vision of a single given object, identifying the type and controlled opening of the cup from said cup assembly normal to the plane of said conveyor while in motion and making the placed objects fall in different collecting chutes of collecting chutes assembly thus grouping and grading them according to their same properties and characteristics.

* * * * *